US006848405B1

(12) United States Patent
Dow et al.

(10) Patent No.: US 6,848,405 B1
(45) Date of Patent: Feb. 1, 2005

(54) SELF-RELIEVING CHOKE STARTING SYSTEM FOR A COMBUSTION ENGINE CARBURETOR

(75) Inventors: Paul J. Dow, Cass City, MI (US); Joseph M. Graham, Cass City, MI (US)

(73) Assignee: Walbro Engine Management , L.L.C., Tuson, AZ (US)

( * ) Notice: Subject to any disclaimer, the term of this patent is extended or adjusted under 35 U.S.C. 154(b) by 4 days.

(21) Appl. No.: 10/621,937

(22) Filed: Jul. 17, 2003

(51) Int. Cl.[7] ..... F02M 1/02
(52) U.S. Cl. ..... 123/179.18; 261/52
(58) Field of Search ..... 261/52, 61, 64.6; 123/179.18, 185.14, 185.1, 339.25

(56) References Cited

U.S. PATENT DOCUMENTS

| | | | | | |
|---|---|---|---|---|---|
| 4,123,480 | A | * | 10/1978 | Johansson | 261/52 |
| 4,200,595 | A | * | 4/1980 | Dye | 261/39.3 |
| 5,200,118 | A | * | 4/1993 | Hermle | 261/64.6 |
| 5,500,159 | A | * | 3/1996 | Martinsson | 261/52 |
| 5,611,312 | A | * | 3/1997 | Swanson et al. | 123/436 |
| 6,000,683 | A | * | 12/1999 | Van Allen | 261/52 |
| 6,202,989 | B1 | * | 3/2001 | Pattullo | 261/52 |
| 6,439,547 | B1 | * | 8/2002 | King et al. | 261/52 |
| 6,454,245 | B2 | * | 9/2002 | Kobayashi | 261/52 |
| 6,494,439 | B1 | * | 12/2002 | Collins | 261/52 |
| 6,641,118 | B2 | * | 11/2003 | Schliemann | 261/52 |
| 2003/0052422 | A1 | * | 3/2003 | Schliemann | 261/52 |

* cited by examiner

*Primary Examiner*—Henry C. Yuen
*Assistant Examiner*—Arnold Castro
(74) *Attorney, Agent, or Firm*—Reising, Ethington, Barnes, Kisselle, P.C.

(57) ABSTRACT

A self-relieving choke starting system for a carburetor of a combustion engine has an elongated cammed latch which projects radially outward from a rotating shaft of a choke valve located in an upstream region of a fuel-and-air mixing passage carried by a body of the carburetor. During a first attempt at starting a cold engine, the user manually rotates the choke valve from a spring biased open to a full choke position whereupon a cam end of the latch contacts a follower arm, which projects radially outward from a rotating shaft of a throttle valve located downstream of a venturi of the mixing passage. As the choke valve manually rotates closed, the throttle valve automatically rotates in an open direction against the biasing force of a throttle spring from a slow idle state, for normal engine operation, to a fast idle state for engine starting. Once the choke valve is in the full choke position and the throttle valve is in the fast idle position, a rich mixture of fuel-and-air will flow into the combustion chamber of the engine during the first attempt at starting the cold engine. If the first attempt should fail, the user can manually rotate the choke valve in an open direction to a half-choke position while the throttle valve is automatically maintained in the fast idle position to provide a slightly leaner mixture of the fuel-and-air to the engine for following attempts at cold starting.

12 Claims, 3 Drawing Sheets

FULL CHOKE ( 15°)
FAST IDLE ( 35°)

FULL CHOKE ( 15°)
FAST IDLE ( 35°)

HALF CHOKE (48°)
FAST IDLE ( 35°)

OPEN CHOKE (90°)
CLOSED THROTTLE (15°)

OPEN CHOKE (90 )
WIDE OPEN THROTTLE (90 )

SELF-RELIEVING CHOKE STARTING SYSTEM FOR A COMBUSTION ENGINE CARBURETOR

FIELD OF THE INVENTION

The present invention relates generally to a carburetor for a combustion engine, and more particularly to a self-relieving choke starting system of the carburetor.

BACKGROUND OF THE INVENTION

Conventional carburetors for internal fuel combustion engines are known to have a fuel-and-air mixing passage for delivering a controlled ratio of fuel-and-air to the combustion chamber of a running two or four stroke engine. The mixing passage is carried by a body of the carburetor and has a venturi disposed between an upstream region and a downstream region of the passage. Generally controlling or limiting the amount of air flowing through the venturi is a choke valve of a butterfly-type disposed within the upstream region of the passage. Generally controlling the amount of fuel-and-air mixture fed to the combustion chamber of a running engine is a throttle valve, also of a butterfly-type, which is disposed within the downstream region of the passage. As the throttle valve rotates from a substantially closed or slow idle position to a wide open throttle position and the choke valve is open, the engine rpm will generally increase from idle to maximum or full power. At wide open throttle, a vacuum induced at the venturi increases with the increased air flow demand of the engine. This causes an increase in fuel flow typically from a near atmospheric fuel supply chamber, through a fuel feed passage and a fuel orifice disposed at a radially most inward portion of the venturi.

The ratio of fuel-to-air of a running engine is generally less than the ratio necessary to reliably start a cold engine. The choke valve is primarily necessary to adjust the fuel-to-air ratio by controlling the air flow rate through the upstream region of the mixing passage. Prior to starting of a cold engine, the user must first manually place the choke valve in a substantially closed or "choke-on" position. The air flow is thus limited and a rich mixture of fuel-and-air flows through an intake manifold and to the combustion chamber of the engine via the pulsating vacuum induced by the reciprocating piston(s) of the engine.

Some typical carburetors are known to have a throttle follower arm which interacts with a latch or cam member of the choke valve actuation mechanism when the choke valve is in a closed position. This interaction is designed to slightly open the throttle valve from the slow idle position to a fast idle position for improved starting of a cold engine. The follower arm projects radially outward from a rotating shaft of the throttle valve and a coiled spring, engaged between the body and shaft or follower arm biases the throttle valve toward the slow idle position. When the choke valve is in the full open or off position, the throttle valve is free to rotate into the slow idle position via the bias of the throttle spring unless the user of the engine demands more power and manual rotates the throttle shaft against the resilience or biasing force of the throttle spring toward the wide open throttle position via some conventional throttle lever or mechanism which interacts directly with the user.

During cold starting of an engine, the choke valve is typically rotated manually away from the open position causing a distal end of the cam member, which projects radially outward from a choke shaft, to engage an opposing concave edge of the follower arm. This engagement causes the throttle valve to automatically rotate from the spring biased slow idle position to a preestablished fast idle position that will deliver more fuel and air to the combustion chamber than the slow idle position during starting. The opposing concave edge has a constant radius measured with respect to the rotational axis of the choke valve and which corresponds to the length of the cam member from the same axis so that regardless of the choke valve position, (other than the substantially open position) the throttle valve remains in the fast idle position during starting.

Unfortunately, once the engine has started, the user must remember to manually place the choke valve in the open or "choke-off" position to lean-out the fuel-and-air mixture to achieve smooth running of the engine. If the user does not timely remember to manually place the choke valve in an open or "choke-off" position after start-up, and during initial running conditions, the engine may stall on an overly rich mixture of fuel-and-air, or, a black smoke will be emitted from the exhaust, indicative of an unwanted increase in hydrocarbon emissions. Moreover, if the user attempts to increase rpm's of the running engine with the choke valve substantially closed, the air demands of the engine will not be met and the engine will stall on an excessively rich mixture of fuel-and-air. This condition aggravates manufacturer compliance with various regulatory emission standards established by governmental agencies. Moreover, for small displacement engine applications utilizing manual pull start cords, the engine may not start on the first pull. Unfortunately, a second pull of the pull start cord with the choke valve fully closed and the throttle valve in the fast idle position may flood the engine without an increase in air flow for the second start attempt.

SUMMARY OF THE INVENTION

A self-relieving choke starting system for a carburetor of a combustion engine has an elongated cammed latch which projects radially outward from a rotating shaft of a choke valve located in an upstream region of a fuel-and-air mixing passage carried by a body of the carburetor. During a first attempt at starting a cold engine, the user manually rotates the choke valve from a spring biased open position to a full choke position whereupon a cam end of the latch contacts a follower arm, which projects radially outward from a rotating shaft of a throttle valve located downstream of a venturi of the mixing passage. As the choke valve manually rotates closed, the throttle valve automatically rotates in an open direction against the biasing force of a throttle spring from a slow idle state for normal engine operation to a fast idle state for engine starting. Once the choke valve is in the full choke position and the throttle valve is in the fast idle position, a rich mixture of fuel-and-air will flow into the combustion chamber of the engine during the first attempt at starting the cold engine. If the first attempt should fail, the user can manually rotate the choke valve in an open direction to a half-choke position while the throttle valve is automatically maintained in the fast idle position to provide a slightly leaner mixture of the fuel-and-air to the engine for following attempts at cold starting.

When the engine has started, manual rotation of the throttle valve in an opening direction from the fast idle position (i.e. by actuation of a user throttle control) will release the follower arm from the latch of the choke valve. The choke spring will then automatically return the choke valve to the full open position to further lean-out the fuel-and-air mixture for normal engine operation.

Objects, features and advantages of this invention include a user friendly carburetor which automatically returns the choke valve to an "off" or fully open position after the engine has successfully started, improves engine start-up on successive attempts, avoids engine stalling during startup and warmup, reduces hydro-carbon emissions, is of a relatively simple and robust design, self contained to the carburetor, of economical manufacture and assembly and improves fuel economy.

BRIEF DESCRIPTION OF THE DRAWINGS

These and other objects, features and advantages of this invention will be apparent from the following detailed description of the preferred embodiment and best mode, appended claims, and accompanying drawings in which:

DETAILED DESCRIPTION OF THE PREFERRED EMBODIMENTS

Figure 1:
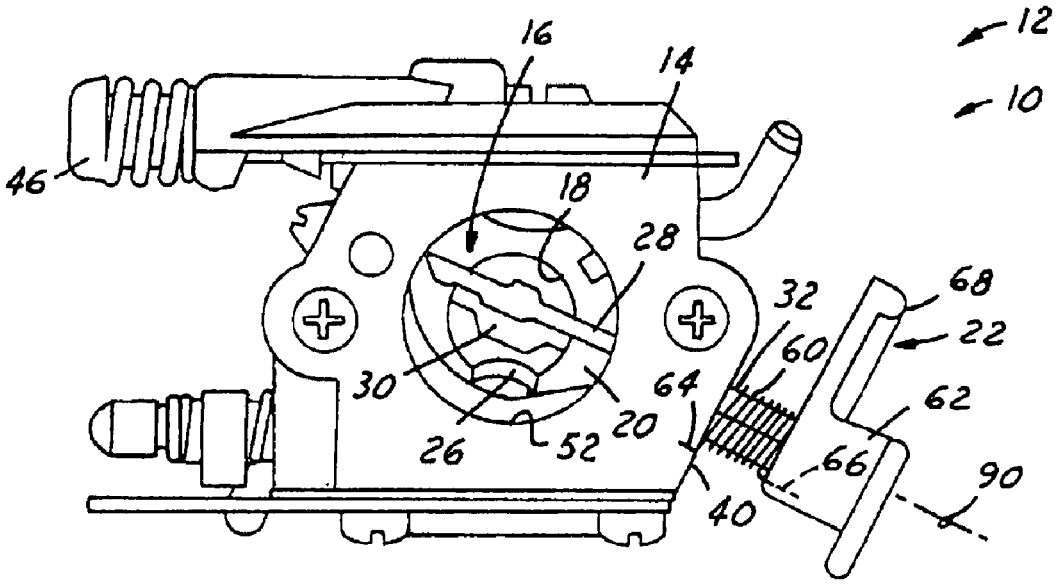
FIG. 1 is an end view of the carburetor having a choke starting system of the present invention.
Figure 2:
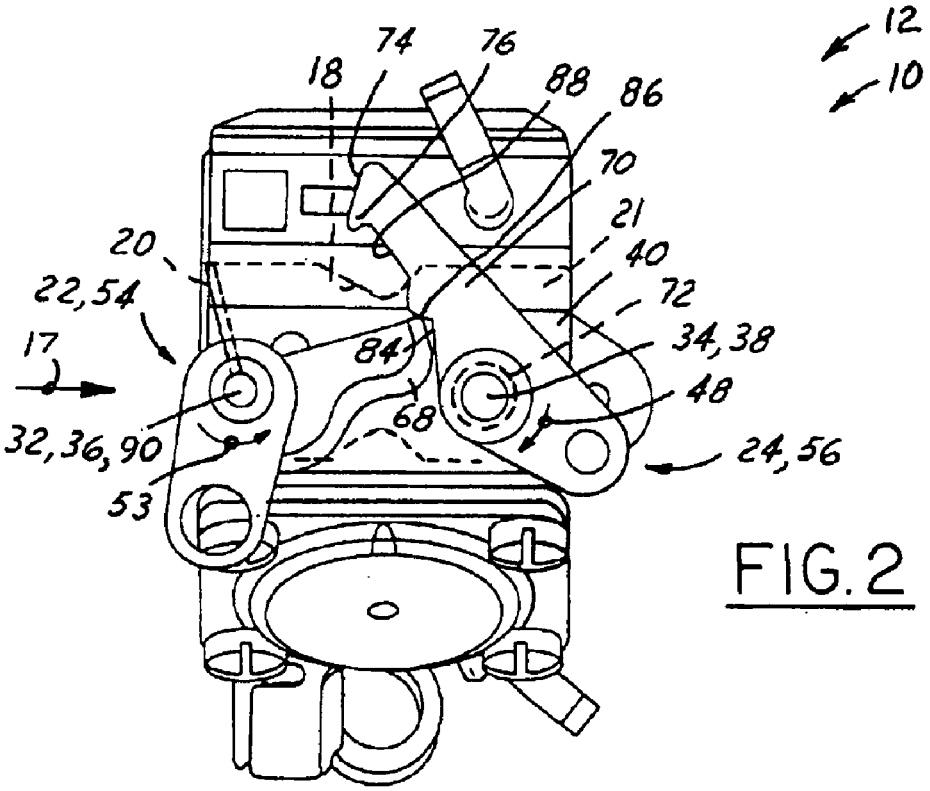
FIG. 2 is a perspective view of the carburetor illustrating a choke valve of the choke starting system in a closed position and a throttle valve of the choke valve system in a fast idle position.

Referring in more detail to the drawings, FIGS. 1 and 2 illustrate a self-relieving choke starting system 10 of the present invention integrated generally into a carburetor 12 preferably for a small displacement two or four stroke combustion engine, such as that used for manual pull cord start applications and/or such as chainsaws and lawnmowers (not shown). A body 14 of the carburetor 12 has a fuel-and-air mixing passage 16 for delivering a controlled ratio of fuel-and-air mixture to a combustion chamber of the running engine. Air at near atmospheric pressure flows in the direction of arrow 17 through a venturi 18 in the mixing passage 16. The venturi 18 is disposed between an upstream region 20 of the mixing passage 16 and a downstream region 21 which communicates with an intake manifold of the engine.

A butterfly-type choke valve 22 located rotatably in the upstream region 20 of the mixing passage 16 assists starting of a cold engine by limiting air flow through the mixing passage 16 and venturi 18. A butterfly-type throttle valve 24 interacts mechanically with the choke valve 22 during cold starts and is free to operate independently during normal operation of the engine for controlling engine speed and/or power. Liquid fuel flows into the mixing passage 16 through a main fuel orifice or nozzle 26 preferably disposed in a throat of the venturi 18 and through an idle circuit (not shown) having at least one idle aperture disposed downstream of the closed throttle valve in the mixing passage 16. Both the idle circuit aperture and the main fuel nozzle 26 flow fuel from a fuel source which is preferably controlled at near atmospheric pressure. The fuel source can be a conventional diaphragm fuel metering chamber or a conventional carburetor float bowl (although the idle circuit and fuel source are not herein illustrated, it is taught in Burns et al., U.S. Pat. No. 6,536,747, incorporated herein by reference). Fuel is induced to flow into the mixing passage 16 via a vacuum pressure produced by a reciprocating piston of the combustion engine. The amount of fuel flowing into the mixing passage 16 from the main fuel nozzle 26 and the idle circuit aperture is dictated by the level of vacuum pressure at the main fuel nozzle and the vacuum pressure at the idle circuit aperture. Vacuum pressure is controlled by positioning of the choke and throttle valves 22, 24.

Each valve 22, 24 has a plate or disc 28, 30 pivotally mounted in their respective regions 20, 21 of the mixing passage 16 and which substantially conform in shape to the contours of the walls of the respective regions. The plates 28, 30 pivot via respective shafts 32, 34 mounted rotatably in the body 14 and attached rigidly to the plates 28, 30 by some type of fastener. The shafts 32, 34 are substantially parallel to one-another and extend substantially laterally or transversely through their respective regions 20, 21 of the mixing passage 16. Each shaft 32, 34 has a distal end 36, 38 projecting through an exterior 40 of the carburetor body 14 for engagement to various user mechanical linkages or interfaces.

Figure 4:
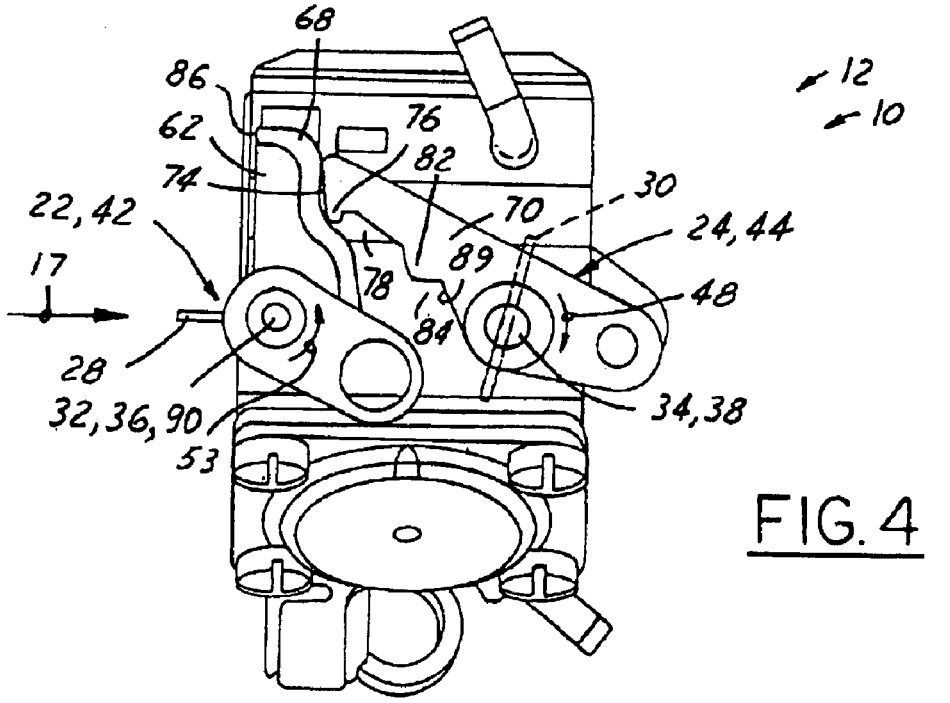
FIG. 4 is a perspective view of the carburetor illustrating the choke valve in an open position and the throttle valve in a slow idle position.

Referring to FIG. 4, during slow idle or normal idle running conditions of a warm engine, the choke valve 22 is in an open or "off" position 42 and the throttle valve 24 is in a substantially closed normal or slow idle position or state 44 for a warm engine. Thus, the choke valve 22 is not necessarily utilized to restrict air flow, however, because the engine at slow idle requires only a relatively small volume of fuel and air, the throttle valve 24 is substantially closed when in the slow idle state 44. This greatly limits the amount of vacuum pressure at the venturi 18 which minimizes or eliminates fuel flow through the main fuel nozzle 26. Consequently, at least the majority of fuel supplied to the combustion chamber at slow idle flows from the idle circuit aperture(s) which are preferably disposed immediately downstream of a peripheral edge of the closed throttle plate 30 and are thus exposed to the vacuum pressure at the intake manifold.

For smooth and reliable engine idling, a slow idle adjustment screw 46 (as best shown in FIG. 1) mechanically interacts with the shaft 34 of the throttle valve 24 to slightly pivot the plate 30 in an open-clockwise direction designated by arrow 48. This slight opening of the throttle valve 24 causes a slight increase in the volume of air flow and may expose additional idle circuit apertures located immediately upstream of the peripheral edge of the throttle plate 30 to an increase in vacuum pressure. With the additional air flow and the additional fuel flow through the additionally exposed idle circuit apertures, the idling speed of the engine will slightly increase to the satisfaction of the user.

Figure 5:
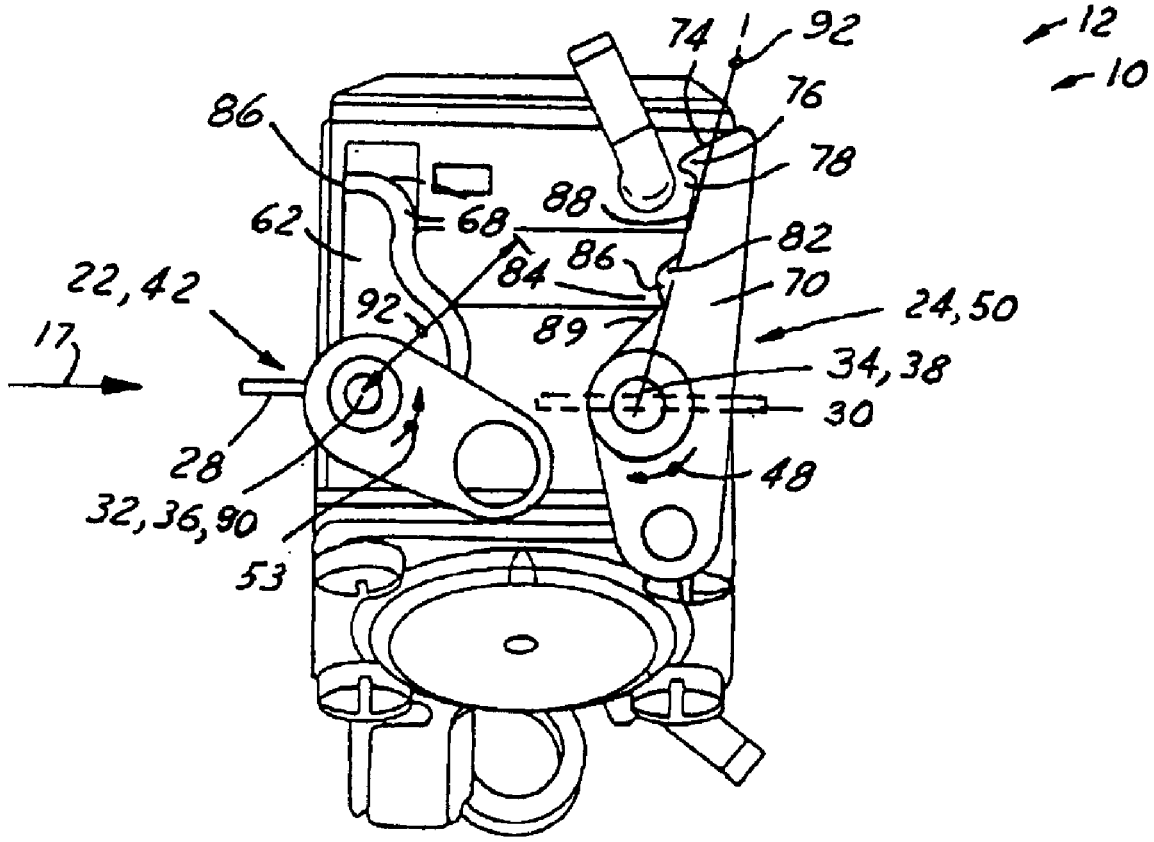
FIG. 5 is a perspective view of the carburetor illustrating the choke valve in the open position and the throttle valve in a wide open throttle position.

Referring to FIG. 5, during high running speeds or power production of a warm engine, the choke valve 22 is in the open or "off" position 42 so as not to restrict air flow and the throttle valve 24 is near or in a wide open throttle position or state 50. When in this condition, no mechanical interaction occurs between the choke and throttle valves 22, 24. Moreover, any additional opening of the throttle valve 24 toward the wide open state 50 will increase air flow through the venturi 18 which increases vacuum at the main fuel nozzle 26 and thus fuel flow through the nozzle from the constant near atmospheric pressure fuel source or metering chamber. With the opening of the throttle valve 24 from the slow idle slate 44, the vacuum pressure at the slow idle circuit aperture(s) is greatly reduced causing the majority, if not all, of the fuel to flow from the main fuel nozzle 26.

Preferably, when the planar plate 28 of the choke valve 22 and the planar plate 30 of the throttle valve 24 are closed, the plates are orientated at an approximate rotational fifteen degree offset or included angle from an imaginary plane disposed perpendicular to the fuel-and-air mixing passage 16. This offset assures that the plates 28, 30 seat against an internal wall 52 of the carburetor body 14 within their respective regions when closed. Hence, the full range of pivotal or rotational movement from a full "full choke" or closed position 54 to the full open position 42 of the plate 28 of the choke valve 22 is approximately seventy-five degrees in a counter-clockwise direction as identified by arrow 53. Similarly, the plate 30 of the throttle valve 24 (with the exception of when the slow idle position 44 has been adjusted by the slow idle screw 46) pivots counter to the choke valve or in a clockwise direction (arrow 48) approximately seventy-five degrees from the full closed to the full open positions 44, 50. When the plates 28, 30 are in the full open positions 42, 50 they are substantially co-planar to one-another and substantially parallel to a centerline of the mixing passage 16.

Referring to FIG. 2, in order to achieve a reliable start of a generally cold engine, flow of a rich fuel-and-air mixture to the combustion engine is desirable, if not necessary. To produce a rich fuel-and-air mixture, the choke valve 22 is manually rotated to the "full choke" or closed position 54 thus appreciably limiting air flow through the mixing passage 16, and which automatically, via the self-relieving choke starting system 10, rotates the throttle valve 24 from the slow idle position 44 to a preestablished fast idle position 56. Preferably, the fast idle position 56 reflects an offset position of the plate 30 of approximately thirty-five degrees which is a twenty degree movement in the open direction (arrow 48) from the slow idle position 44, or approximately twenty-seven percent of the total range of angular travel from full closed to full open. Opening the throttle valve 24 by approximately twenty degrees, or to an approximate thirty-five degree offset, exposes the main fuel feed nozzle 26 to the pulsating vacuum pressure produced by the reciprocating piston of the engine and transmitted via the intake manifold. The start-up vacuum pressure is static-like in the sense that it is not produced by a venturi effect and is held within the mixing passage 16 via the closed choke plate 28. Consequently, an appreciable amount of fuel flows into the combustion chamber with relatively little air flow from both the idle circuit apertures and the main fuel nozzle 26 for cold starting of the engine.

Figure 3:
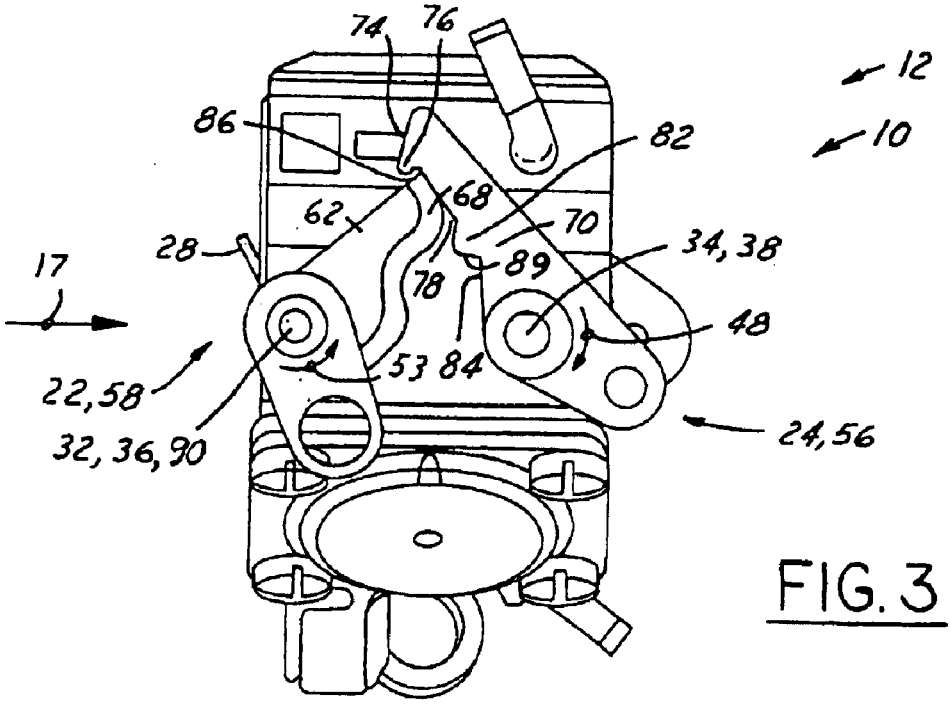
FIG. 3 is a perspective view of the carburetor illustrating the choke valve in an intermediate partial choke position and the throttle valve in the fast idle position.

However, if the engine does not start on a first attempt (such as the first pull of a start-cord on a chainsaw), or if the operator fails to release the choke by actuating the throttle thus stalling the engine on an overly rich mixture of fuel and air, a second or third pull of the start-cord could further flood the combustion chamber with too much fuel and thereby inhibit starting of the engine. Thus, the self-relieving choke starting system 10 has a second configuration of choke and throttle valve position combinations for starting a cold engine on second and later attempts. For instance, on a second cold engine start attempt, the user can rotate the choke valve 22 in the open direction (arrow 53) from the closed position 54 to a factory-set intermediate or half choke position 58 while automatically maintaining the throttle valve 24 in the factory-set fast idle position 56, as best shown in FIG. 3.

To produce a slightly leaner fuel-and-air mixture from that of the first start attempt, the choke valve 22 is manually rotated to the half choke position 58 thus upon engine cranking increasing the air flow through the mixing passage 16 and decreasing the static vacuum in the mixing passage at the main fuel nozzle 26 and the idle circuit apertures. Preferably, the half choke position 58 reflects an angular offset of the plate 28 of approximately forty-eight degrees which is a thirty-three degree rotation in the open or "choke off" direction (arrow 53) from the closed position 54, or approximately forty-four percent of the total range of angular travel from full closed to full open of the choke. Because the throttle valve 24 is only opened to an approximate thirty five degree offset, or twenty-seven percent, the speed of the engine is kept at a reasonable limit immediately following start and prior to user intervention by movement of the throttle.

The choke starting system 10 is self-relieving because the choke valve 22 automatically opens or rotates counter-clockwise (arrow 53) from either the closed position 54 or the half choke position 58 to the open position 42 without direct user intervention. The only indirect user intervention required is movement of the throttle to rotate the throttle valve 24 in an open direction (arrow 48) beyond the fast idle position 56 which releases the mechanical interface between the two valves 22, 24, and allows a resilient coiled spring 60 disposed concentrically about the distal end 36 of the shaft 32 to rotate the choke valve 22 into the open position 42.

Referring to FIGS. 1 and 2, the coiled spring 60 is orientated axially between the exterior 40 of the body 14 and a latch 62 fixed to the distal end 36 of the shaft 32. A first end 64 of the spring 60 engages the body 14 and an opposite second end 66 engages the latch 62. The latch 62 projects radially outward from the shaft 32 and has a cam contact or end 68 of the latch which interfaces directly with a follower arm 70 fixed to and projecting radially outward from the distal end 38 of the shaft 34 of the throttle valve 24 when the valves 22, 24 are in a configuration for cold engine starts, as previously described and best illustrated in FIGS. 2 and 3.

The throttle valve 24 also carries a coiled spring 72 (shown in phantom FIG. 2) wrapped about the distal end 38 of the shaft 34 and received between the body and the follower arm 70 which biases the throttle valve 24 in a closing direction or into the slow idle position 44 and not in the opening direction (arrow 48).

Consequently, during cold engine starts, the user rotates the choke valve 22 from the open position 42 against the bias of the spring 60 and in a closing direction (opposite arrow 53) at which point the cam end 68 of the latch 62 makes initial contact with a generally opposing radially outward facing sloped face 74 which congruently merges into a radially outward side of a first stop tab 76 of the follower arm 70, wherein the tab 76 projects substantially circumferentially in a counter-clockwise direction generally toward the latch 62. As the choke valve 22 continues to rotate in a closing direction, the throttle valve 24, via contact with the follower arm 70, rotates in the opening direction (arrow 48) against the biasing force of the throttle spring 72. This rotation continues until the throttle valve 24 rotates slightly beyond the fast idle position 56 in order for the cam end 68 to clear the first tab 76. Once cleared, the cam end 68 snaps into a first indent or notch 78 defined by a first concave face 80 carried by the follower arm 70 at which point the choke valve 22 is in the half choke position 58 and the throttle valve 24 is in the fast idle position 56 as shown in FIG. 3.

However, because it is an "initial" or first start attempt of a cold engine, the user will want to place the choke valve 22 in the "choke on" or closed position 54 to achieve a rich fuel-and-air mixture and thus will continue to rotate the valve 22 in the closing direction during which the cam end 68 encounters a second circumferentially projecting stop tab 82 spaced radially inward from the first stop tab 76 by the first indent 78. Consequently, prior to the first start attempt, the follower arm 70 will pivot causing the throttle valve 24 to further rotate in the open direction (48) against the increasing bias force of the spring 72 until the cam end 68 passes the second stop tab 82 and snaps into a second indent or notch 84 of the follower arm 70 spaced radially inward from the first indent 78 by the second stop tab 82. Once seated, the biasing force of the throttle spring 72 is strong enough to keep the cam end 68 in the second indent 84 preventing a trailing stop surface 86 of the cam end 68 engaged to the second stop tab 82 from sliding back over the second stop tab 82 under the biasing force of the choke spring 60.

Should the engine start on the first attempt, the user should soon after depress a throttle control (not shown) to rotate the throttle valve 24 from the fast idle position 56 and in an opening direction (arrow 48) to release the follower arm 70 by circumferentially clearing the stop tabs 76, 82 so that the biasing force of the choke spring 60 can return the choke valve 22 to the open position 42 for normal operation of the engine. However, if the engine does not start on the first attempt, the user can overcome the forces of the choke and throttle springs 60, 72 and the interference of the second stop tab 82 by applying an external force to rotate the choke valve 22 from the closed position 54 to the half choke position 58 for reasons previously discussed. Assuming the engine starts, the user may again release the choke by opening the throttle valve 24.

The throttle valve 24 is generally maintained in the fast idle position 56 as the choke valve 22 rotates between the full choke and half choke positions 54, 58 because a first and second bottom or defining face 88, 89 of respective indents 78, 84 are generally equally spaced from a rotational axis 90 of the choke shaft 32 when the throttle valve 24 is in the fast idle state 56. This spacing between axis 90 and either face 88, 89 is generally equal to a length or radius 92 measured between the rotational axis 90 and a cam surface 94 of the cam end 68 which contacts the faces 88, 89. In-other-words, the indent faces 88, 89 are generally located tangentially to an imaginary circle having radius 92 and centered about the rotational axis 90. Moreover, further adjustments or refinements to the rich fuel-and-air mixture can be made by adding additional radially spaced indents with bottom faces spaced from axis 90 by a length 92 thus creating additional partial choke positions; and/or the bottom face of any particular indent can be re-aligned upon the follower arm 70 thus increasing or decreasing the length 92 between the choke rotational axis 90 and the particular face measured with respect to the throttle valve 24 being in the originating fast idle state 56 thus creating a range of fast idle states dictated by any number of partial or full choke positions.

While the forms of the invention herein disclosed constitute a presently preferred embodiment, many others are possible. It is not intended herein to mention all the possible equivalent forms or ramifications of the invention. It is understood that terms used herein are merely descriptive, rather than limiting, and that various changes may be made without departing from the spirit or scope of the invention as defined by the following claims.

We claim:

1. A self-relieving choke starting system of a carburetor for a combustion engine comprising:

a body of the carburetor;

an elongated fuel-and-air mixing passage defined by the body;

a choke valve having a rotating shaft extending laterally through the fuel-and-air mixing passage and through the body, and a latch projecting radially outward from the choke shaft;

wherein the choke shaft rotates between an open position, an intermediate position, and a closed position;

a throttle valve having a rotating shaft extending laterally through the fuel-and-air mixing passage and through the body and a follower arm projecting radially outward from the throttle shaft;

wherein the throttle shaft rotates between a full throttle state, a fast idle state and a slow idle state;

a throttle spring operably connected to the throttle valve and biasing the throttle valve toward the slow idle state;

the latch carrying a cam end;

the follower arm having a first indent and a second indent disposed radially inward from the first indent with respect to the throttle shaft; and wherein the cam end is located in the first indent when the choke valve is in the intermediate position and the throttle valve is in the fast idle state, and wherein the cam end is located in the second indent when the choke valve is in the closed position and the throttle valve is in the fast idle state.

2. The self-relieving choke starting system set forth in claim 1 comprising a coiled choke spring engaged to the body at one end and engaged to the choke valve at an opposite end for biasing the choke valve toward the open position.

3. The self-relieving choke starting system set forth in claim 2 wherein the throttle spring biases the throttle shaft in a counter-clockwise direction and the choke spring biases the choke shaft in a clockwise direction.

4. The self-relieving choke starting system set forth in claim 1 comprising:

the cam end of the latch having a leading cam surface and a trailing stop surface;

the follower arm having a first tab projecting circumferentially outward with respect to the throttle shaft, a second tab spaced radially inward from and co-extending with the first tab, wherein the first indent is disposed radially between the first and second tabs and the second indent is disposed radially inward from the second tab; and wherein the trailing stop surface engages the first tab when the cam end is in the first indent and wherein the trailing stop surface engages the second tab when the cam end is in the second indent.

5. The self-relieving choke starting system set forth in claim 1 comprising:

a convex cam surface carried by the cam end of the latch;

the follower arm having a concave first face defining the first indent, and a concave second face defining the second indent; and wherein the first and second faces generally oppose the leading cam surface.

6. The self-relieving choke starting system set forth in claim 1 wherein the choke and throttle valves are of a butterfly-type each having a plate disposed pivotally in the fuel-and-air mixing passage and being engaged to the respective shafts, and wherein the choke and throttle shafts rotated to pivot the choke and throttle plates.

7. The self-relieving choke starting system set forth in claim 2 wherein the opposite ends of the choke and throttle springs are engaged to the respective latch and follower arm.

8. A self-relieving choke starting system of a carburetor for a combustion engine comprising:

a body of the carburetor;

an elongated fuel-and-air mixing passage defined by the body;

a butterfly-type choke valve having a choke plate disposed pivotally in the fuel-and-air mixing passage, a choke shaft connected to the choke plated and extending laterally through the fuel-and-air mixing passage and through the body, and a latch projecting radially outward from a distal end of the choke shaft;

wherein the choke shaft rotates to pivot the choke plate between an open position and a closed position;

a choke spring operably connected to the choke valve and biasing the choke valve and toward the open position;

a butterfly-type throttle valve having a throttle plate disposed pivotally in the fuel-and-air mixing passage, a throttle shaft connected to the throttle plate and extending laterally through the fuel-and-air mixing passage and through the body, and a follower arm projecting radially outward from a distal end of the throttle shaft;

wherein the throttle shaft rotates to pivot the throttle plate between a full throttle state, a fast idle state and a slow idle state;

a throttle spring operably connected to the throttle valve and biasing the throttle valve toward the slow idle state;

the latch having a cam end;

the follower arm having a first indent opening generally toward the cam end; and wherein the cam end is received in the first indent when the choke valve is not in the open position and the throttle valve is in the fast idle state and wherein rotation of the throttle shaft against the biasing force of the throttle spring and toward the full throttle state releases the latch from the follower arm and the biasing force of the choke spring returns the choke valve to the open position.

9. A self-relieving choke starting system of a carburetor for a combustion engine comprising:

a body of the carburetor;

an elongated fuel-and-air mixing passage defined by the body;

a choke valve having a choke shaft rotatably carried by the body and extending laterally through the fuel-and-air mixing passage, an elongated latch projecting radially outward from a distal end of the choke shaft and disposed externally to the body, an open position for normal operation of the engine, a close position for initial starting of the engine when cold, and at least one intermediate position for successive attempts at starting a cold engine;

a throttle valve having a throttle shaft rotatably carried by the body, and extending laterally through the fuel-and-air mixing passage, an elongated follower arm disposed externally to the body and projecting radially outward from the throttle shaft, a full throttle state for high speed running of the engine, a fast idle state for starting of the engine when cold, and a slow idle state for normal idling of the engine;

a throttle spring operably connected to the throttle valve and biasing the throttle vale toward the slow idle state;

the latch having a cam contact and a radial length measured between a rotational axis of the choke shaft and the cam contact;

the follower arm having a plurality of contact faces spaced radially from one-another with respect to the throttle shaft;

wherein each face of the plurality of contact faces is spaced generally at the radial length from the rotational axis of the choke shaft when the throttle valve is in the fast idle state; and wherein the cam contact is biased against any one of the plurality of contact faces when the choke valve is not in the open position and the throttle valve is in the fast idle state.

10. The self-relieving choke starting system set forth in claim 9 comprising:

a coiled choke spring engaged to the body at one end and engaged to the latch at an opposite end for biasing the choke valve in a counter-clockwise direction and toward the open position; and wherein clockwise rotation of the throttle shaft against the biasing force of the throttle spring and toward the full throttle state releases the latch from the follower arm and the biasing force of the choke spring automatically returns the choke valve in the counter-clockwise direction to the open position.

11. A method of starting a cold combustion engine comprising the steps of:

manually moving a choke valve in a closing direction from an open position against a biasing force of a choke spring;

contacting a latch of the choke valve to a follower arm of a throttle valve;

automatically moving the throttle valve in an opening direction from a slow idle state against the biasing force of a throttle spring;

engaging the latch with a second indent carried by the follower arm when the choke valve has manually moved to a closed position and the throttle valve has automatically moved to a fast idle position;

failing to start the engine on a first attempt;

manually moving the choke valve in an opening direction from the closed position;

engaging the latch with a first indent carried by the follower arm when the choke valve is manually moved to a half choke position and the throttle valve is maintained in the fast idle position; and attempting a successive start of the engine.

12. The method of starting a cold engine set forth in claim 11 comprising the additional steps of:

starting the engine upon a successive attempt;

manually moving the throttle valve against the biasing force of the throttle spring in the opening direction and from the fast idle position; and automatically returning the choke valve to the open position via the biasing force of the choke spring.

* * * * *

UNITED STATES PATENT AND TRADEMARK OFFICE

CERTIFICATE OF CORRECTION

PATENT NO. : 6,848,405 B1
DATED : February 1, 2005
INVENTOR(S) : Paul J. Dow et al.

It is certified that error appears in the above-identified patent and that said Letters Patent is hereby corrected as shown below:

Column 8,
Line 60, delete “rotated” and insert -- rotate --.

Column 9,
Line 6, delete “plated” and insert -- plate --.

Signed and Sealed this

Tenth Day of May, 2005

JON W. DUDAS
*Director of the United States Patent and Trademark Office*